US005280779A

United States Patent [19]

Smith

[11] Patent Number: 5,280,779

[45] Date of Patent: Jan. 25, 1994

[54] ARCHERY BOW HAVING PIVOTING POCKET FOR BOW LIMB

[75] Inventor: Allan F. Smith, Tucson, Ariz.

[73] Assignee: Precision Shooting Equipment Inc., Tucson, Ariz.

[21] Appl. No.: 780,793

[22] Filed: Oct. 22, 1991

[51] Int. Cl.[5] ..... F41B 5/14

[52] U.S. Cl. ..... 124/88; 124/23.1; 124/25.6

[58] Field of Search ..... 124/88, 86, 25.6, 23.1, 124/80

[56] References Cited

U.S. PATENT DOCUMENTS

| | | | |
|---|---|---|---|
| 3,744,473 | 7/1973 | Nishioka | 124/25.6 |
| 3,841,295 | 10/1974 | Hunter | 124/88 X |
| 3,923,036 | 12/1975 | Jennings et al. | 124/88 |
| 3,957,027 | 5/1976 | Drake | 124/88 |
| 4,061,124 | 12/1977 | Groner | 124/88 X |
| 4,187,826 | 2/1980 | Killian | 124/88 X |
| 4,201,182 | 5/1980 | Butler | 124/88 X |
| 4,261,320 | 4/1981 | Barna | 124/88 X |
| 4,455,990 | 6/1984 | Barna | 124/86 |
| 4,756,295 | 7/1988 | Guzzetta | 124/88 X |
| 5,172,679 | 12/1992 | Mussack | 124/88 X |

FOREIGN PATENT DOCUMENTS

| | | | |
|---|---|---|---|
| 747692 | 12/1966 | Canada | 124/23.1 |
| 811473 | 4/1969 | Canada | 124/23.1 |
| 2459013 | 8/1976 | Fed. Rep. of Germany | 124/86 |

*Primary Examiner*—Randolph A. Reese
*Assistant Examiner*—Harry C. Kim
*Attorney, Agent, or Firm*—Cahill, Sutton & Thomas

[57] ABSTRACT

An archery bow, such as a compound bow, is provided with pivoting pocket members for attaching each limb to the bow handle. Each pocket has a recess for receiving the fixed end of a limb and is attached to the handle by an adjustment bolt through the limb and the pocket. A pair of pocket walls extend away from the recess to straddle the end of the handle. The pocket pivots about a pin passing through the end of the handle and through bores in the walls of the pocket.

20 Claims, 3 Drawing Sheets

ARCHERY BOW HAVING PIVOTING POCKET FOR BOW LIMB

BACKGROUND OF THE INVENTION

This invention relates to bows for archery and, in particular, to a pivoting pocket attached to the bow handle for holding a bow limb in place.

Archery bows are available in a variety of forms. Long bows, recurve bows, compound bows and others are all basically intended to propel an arrow through the flecture of limbs that transfer the stored energy through such flecture to the arrow through a bow string. The present invention is directed to the attachment of flexible limbs to a handle portion of such bows. For example, a recurve bow may incorporate a rigid handle section to which an opposing pair of flexible limbs are secured in a manner unique to recurve bows and familiar to those in the archery industry. Similarly, a compound bow is provided with a rigid handle portion to which flexible limbs are secured; long bows and similar types of archery bows are usually constructed with the handle and limbs formed in a unitary structure without a discernibly separate handle portion or limbs. This invention is directed to those archery bows wherein the limbs are separable from the handle and is specifically directed to overcome the difficulties that may be encountered in the manufacture, mounting, adjustment, and use of limbs attachable to a bow handle.

Compound bows differ from most other bows in that they include wheels or cams (referred to herein as "eccentrics") attached at the free ends of the limbs to obtain a mechanical advantage in bending the bow. Typically, two eccentrics are used, with lacing wound from an anchor at one end of a first limb to the eccentric at the end of the other limb, to the eccentric at the first end, then back to an anchor at the other end. The middle span between the eccentrics contains the serving or region for receiving the nock of the arrow. As used herein, "lacing" can refer to a single piece bowstring or a three piece line comprising two end cables connected by a central stretch between the eccentrics which forms the bowstring. For convenience, the terms may be used interchangeably herein.

Attachment of the limbs to the handle of a compound bow may be particularly critical since the utilization of eccentrics at the outer ends of the limbs usually presents a means for increasing the mechanical advantage and the multiplication of force applied to the limbs, which force is transferred to the handle through the attachment between the limbs and the handle. The prior art, such as represented by U.S. Pat. No. 4,261,320, typically provides a pivot at each end of the handle of a compound bow. The pivot includes a semicircular groove in each end of the handle, perpendicular to the length of the handle. Each limb rests on the flat side of a half-round member near the fixed end of the limb. The curved side of the half-round member rides in the semicircular groove. The sides of the handle extend past the sides of the limb to form a partial pocket. This configuration limits the choice of materials for the pivot. A handle typically comprises aluminum or magnesium, relatively soft materials. A limb typically comprises fiberglass. The half-round member typically comprises a hard plastic. The resulting joint between the limb and the handle is not particularly strong or durable since the bearing material of the pivot comprises the soft metal of the handle and the half-round member of plastic.

In such prior art, the limb extends over the pivot and is attached at its end to the handle. The pivot acts as a fulcrum across which the limb bends as the bowstring is drawn. A bolt attaches the end of the limb to the handle. The bolt is longer than necessary merely to fasten the limb to the handle so that the bolt also provides a means for adjusting the force necessary to draw the bowstring by changing the angle between the handle and the limb. Typically, the bolt is of sufficient length that, when the bolt is unscrewed, the limb is unflexed prior to the bolt becoming fully withdrawn. This enables one to "relax" the bow, for bowstring replacement for example.

Because of the use of stiff limbs in compound bows, the forces on the handle can be considerable. The forces are further increased due to the cams or eccentric wheels which enable one to use a much higher maximum draw weight. The force of the bowstring acting on the end of the limb may not align with the mounting of the limb to the handle, e.g. because of the way the bowstring is statically mounted or because of a sideward force from using a finger release or a sideward force due to the cable guard. The result is a force tending to move the limb from side to side as the bow is held by the archer. Thus the mounting of the limb must be substantial enough to resist these forces so that the bow performs consistently.

Simply making the handle thicker will make it more substantial, but at increased cost to manufacture. The basic difficulty is that limb and handle meet in orthogonal planes. That is, the handle is wider front to rear, as held by the archer, and the limb is wider from side to side. Making pockets as part of the handle requires that the starting billet be substantially thicker than the final thickness of the handle in order to have adequate material for the pockets. This increases the amount of material which must be used and increases the amount of material which must be machined (removed) to form the central portion of the handle.

Canadian Patent 747,692 discloses a take-apart long bow having pivotally adjustable limb portions in separate pockets. A central bore contains a pivot pin and one of three surrounding bores receives a lock pin. Such construction is not adaptable to compound bows because the joint cannot take the forces encountered in a compound bow. Further, even if adaptable, the draw/-weight adjustment is incremental, not continuous, in the bow described in the Canadian patent. Continuous adjustment is desirable and necessary in a compound bow since many or most users prefer that the tiller measurements (perpendicular distance from bowstring to one end of handle) be slightly different (about ⅛ inch) for the upper and lower limbs in a compound bow. A change that small would be virtually impossible to obtain with an incrementally adjustable bow.

In view of the foregoing, it is therefore an object of the invention to provide an improved means for securing the limbs to the handle of archery bows.

A further object of the invention is to provide an improved archery bow in which the limbs are secured to the handle through the use of pivoting pocket members.

Another object of the invention is to provide pocket members for receiving and securing the ends of the limbs of a bow to the bow handle.

A further object of the invention is to provide an improved archery bow in which the components for attaching the limbs to the handle can be of different material from the handle.

Another object of the invention is to facilitate the manufacture of a bow handle from less material when the handle is to be machined.

SUMMARY OF THE INVENTION

The invention achieves the foregoing objects by providing a separate pocket member for receiving the end of a limb. The pocket member attaches at one end to a pivot pin located at or near each end of the handle. The pocket has a recess which receives and closely fits around the end of the limb. The pocket and the end of the limb have corresponding bores therein through which an anchor bolt passes. The anchor bolt has a large head for engaging the outer surface of the limb and has a threaded portion for engaging an anchor pin within the handle. The anchor pin and the pivot pin are approximately parallel and the anchor pin can rotate within the handle as the anchor bolt moves with the end of the limb. Since the handle surrounds the circumferences of the anchor pin and pivot pin, one obtains a stronger, more stable joint. In addition, the pivot pin and pocket member need not be of the same material as the handle, thus enabling optimization of the bearing surfaces. Since the pocket member always contains the end of the limb, a stronger, more stable joint is obtained. Since the pocket is made separately, the width of the pocket does not affect the width of the starting material for the handle.

A more complete understanding of the invention can be obtained by considering the following detailed description in conjunction with the accompanying drawings, in which.

DETAILED DESCRIPTION

Figure 1:
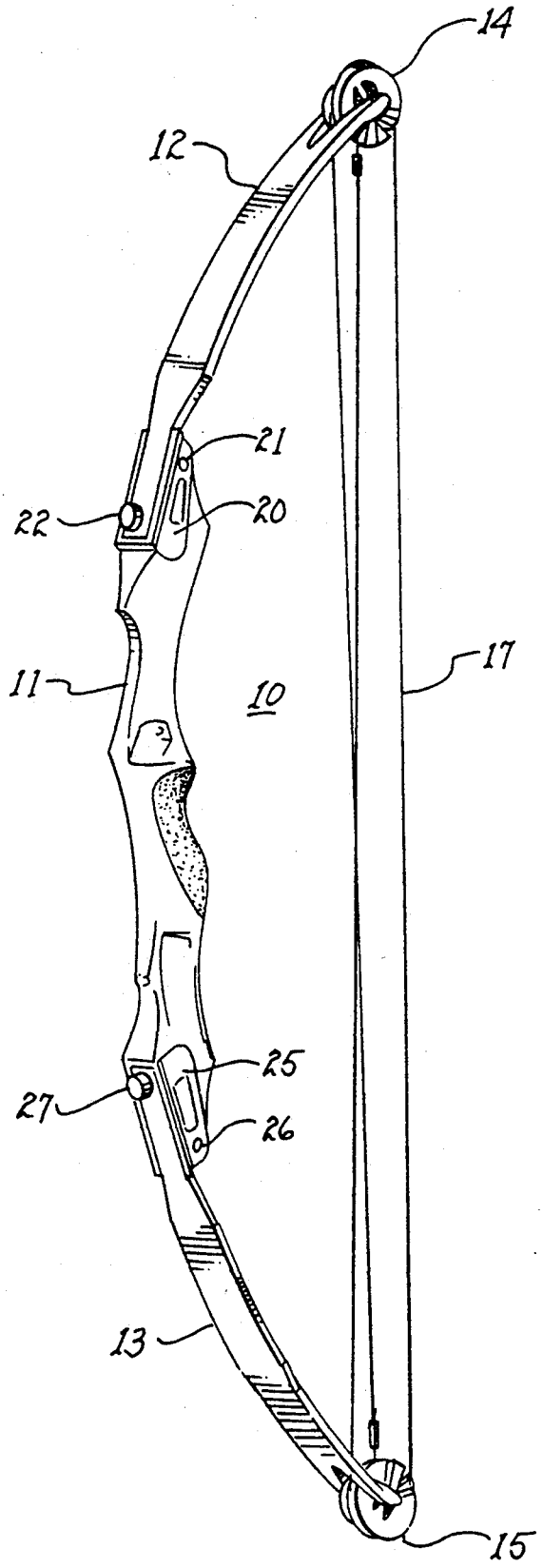
FIG. 1 illustrates a compound bow having a pivoting pocket constructed in accordance with the invention.

FIG. 1 illustrates a preferred embodiment of a compound bow incorporating the teachings of the invention. Bow 10 comprises central handle portion 11 having upper limb 12 and lower limb 13 attached thereto and having the free ends of the limbs interconnected by bowstring 17. Eccentrics 14 and 15 are attached to the free ends of limbs 12 and 13, respectively, and are laced with bowstring 17 in a manner well known in the art.

Upper limb 12 is attached to handle 11 by means of pocket member 20, which pivots about pin 21. Pin 21 extends through a bore in pocket member 20 and a corresponding bore (not shown in FIG. 1) in handle 11. Adjustment bolt 22 is anchored to the handle by extending through the end of limb 12 and through the major surface of pocket member 20 to threadably engage a second pin (not shown in FIG. 1) parallel to pin 21 and contained within handle. Pocket member 25 is of the same construction for attaching lower limb 13. Pocket member 25 pivots about pin 26. Limb 13 is attached to pocket member 25 by adjustment bolt 27 which threadably engages a pin (not shown) parallel to pin 26 and contained within handle 11. Pins 21 and 26 are held in place by any suitable means, such as a bolt and washer attached to each end thereof. Alternatively, snap rings in grooves in the ends of the pins can be used or other mechanism known in the art can be used.

In order to resist flexing, handle 11 is wider in the plane of the drawn bowstring than it is perpendicular to that plane. This shape is conveniently used to advantage by having pocket members 20 and 25 straddle the ends of handle 11 with pocket wall portions thereof, through which pins 21 and 26 pass. This further stabilizes the limbs since the pocket members cannot be moved from side to side with respect to the handle. The result is a strong joint in which the limbs are always fully contained within the pocket members and the pocket members are securely attached to the handle, yet can freely pivot (subject however to the setting of the adjustment bolts to be described).

Handle 11 preferably comprises aluminum or magnesium, either milled or cast. Pins 21 and 26 preferably comprise steel and pocket members 20 and 25 preferably comprise aluminum or magnesium; however, certain plastic materials are likely to provide satisfactory characteristics and can be used in place of metal. Thus, contact between like materials is avoided. Other combinations of materials could be used as well.

Figure 2:
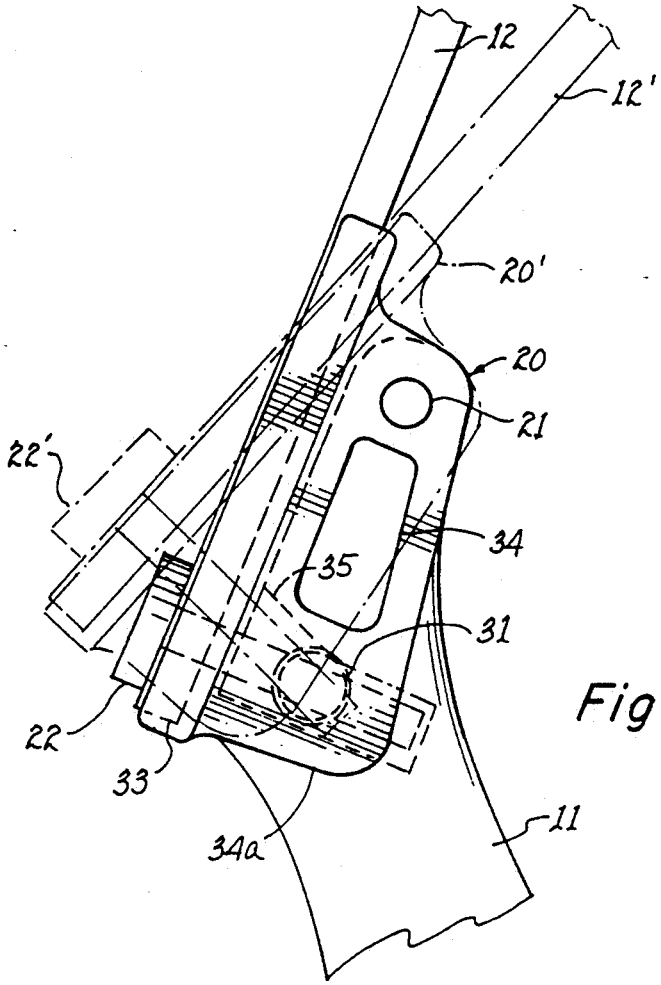
FIG. 2 is an enlarged view of an end of the archery bow of FIG. 1 showing the pivoting pocket in greater detail and showing alternate positions of the pocket and supported limb to facilitate description thereof.

FIG. 2 illustrates the mounting of the limb to the handle in greater detail. Specifically, pocket member 20 incorporates recess 33 therein for receiving limb 12. Extending downwardly from, and approximately perpendicular to, the plane of recess 33 are a pair of walls, of which wall 34 is shown in FIG. 2. This wall is preferably higher at end **34*a* remote from pin 21 to assure that pocket member 20 straddles the handle even at reduced draw weights. The walls also serve to immure or trap anchor pin 31 which is mounted in a bore in handle 11 parallel to the bore for pivot pin 21**.

Threaded adjustment bolt 22 is anchored to handle 11 by threadably engaging pin 31 within cavity 35. Cavity 35 is formed as shown in the end of handle 11, having a tapered cross section in the plane of FIG. 2 to enable bolt 22 to rotate about anchor pin 31 as pocket member 20 rotates about pivot pin 21 when bolt 22 is tightened or loosened. Reference numerals 12', 20', and 22' show the position of the limb, pocket member, and bolt, respectively, at a much reduced draw weight. As used herein, the term "bore" is not necessarily limited to a cylindrical bore. That is, while the preferred embodiment utilizes bores that are right circular cylinders, it will be obvious to those skilled in the art that bores of other cross-sectional configurations can be used. For example, the bore for receiving pin 21 could be other than circular in cross-section so long as the ends of the pin, cooperating with corresponding bores in wall 34 permit the pocket to pivot.

Figure 3:
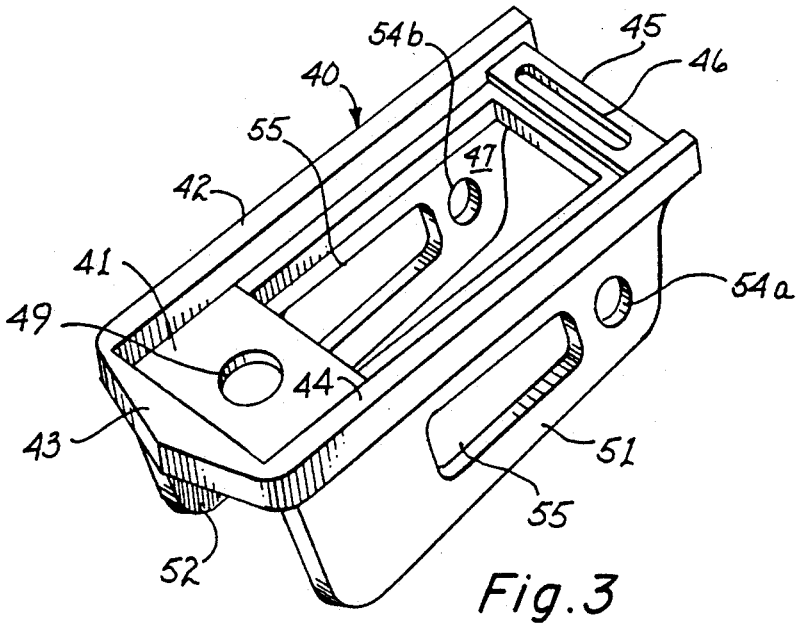
FIG. 3 is an isometric view of a pivoting pocket member constructed in accordance with the teachings of the present invention.

Referring now to FIG. 3, pocket member 40 incorporates recess 41; shoulders 42, 43, and 44 surround recess 41 on three sides and have a height approximately equal to the thickness of the end of the limb. At open end 45, the ends of shoulders 42 and 44 preferably have a radius to avoid having sharp corners that may engage the limb and possibly damage it. The size of the radius is a matter of design. Shoulders 42 and 45 are spaced to closely fit the width of the limb; bore 49 provides clearance for the adjustment bolt.

Rounded slot 46 extends nearly the width of recess 41 and receives a half-round member, not shown. The half-round member extends slightly above the surrounding surface of recess 41 to engage and support the limb. While a preferred embodiment of the invention uses a half-round member, it should be noted that the limb does not pivot on the half-round member as in the prior art. The flat side of the half-round member provides a wide contact area for the limb, which will flex slightly along its entire length even though the majority of the flexing will occur in the middle portion of the limb. Without the half-round member, the limb would bear on the corner of end 45, producing a high stress area in the limb. Neither the half-round slot nor the half-round member need have a cross-section which is exactly a semicircle. In a cross-section, the flat side can be a chord rather than a diameter. Similarly, the round portion is curved, not necessarily exactly circular. Well 47 in recess 41 reduces the mass of the pocket member.

Extending downwardly and approximately perpendicular to recess 41 are walls 51 and 52. These walls extend almost the entire length of the pocket member and are spaced the approximate thickness of handle 11. As previously noted, the height of the walls at open end 45 is less than the height of the walls by shoulder 43. Bore 54*a* is located in the wall near end 45 for receiving the pivot pin. A corresponding bore 54*b* is located in wall 52. Apertures 55 are merely to reduce the weight of the pocket member. Apertures 55 cannot extend too far toward the closed end of the pocket member since the pocket member traps the anchor pin in the handle. Pocket member 40 can be made from aluminum, or plastic, either milled or cast, and if appropriate is preferably anodized to provide a more durable surface. The half-round member preferably comprises a hard, low friction plastic such as nylon.

Figure 6:
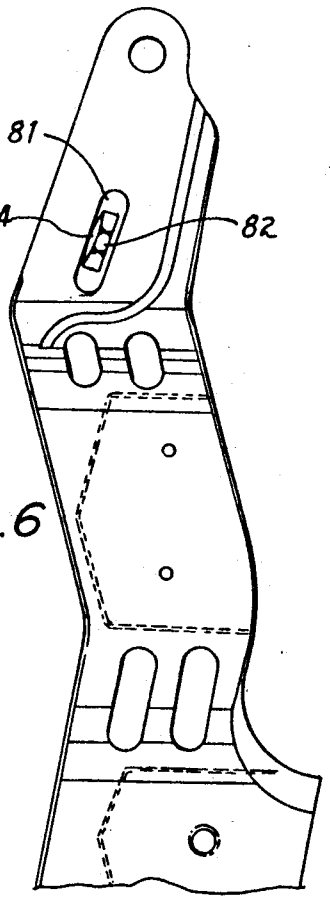
FIG. 6 illustrates another alternative embodiment for anchoring the limb of an archery bow to the handle.
Figure 5:
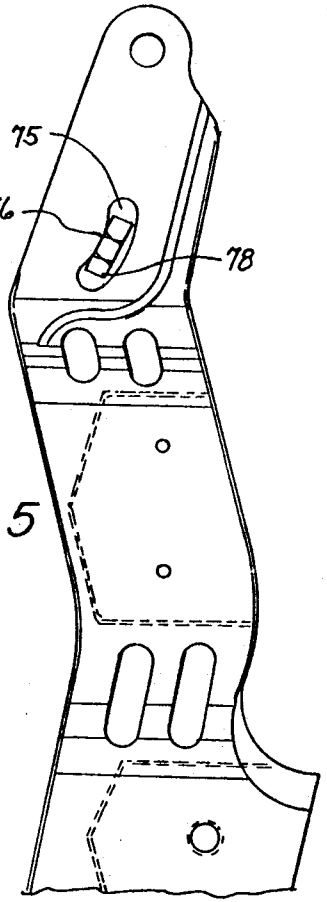
FIG. 5 illustrates an alternative embodiment for anchoring the limb of an archery bow to the handle.
Figure 4:
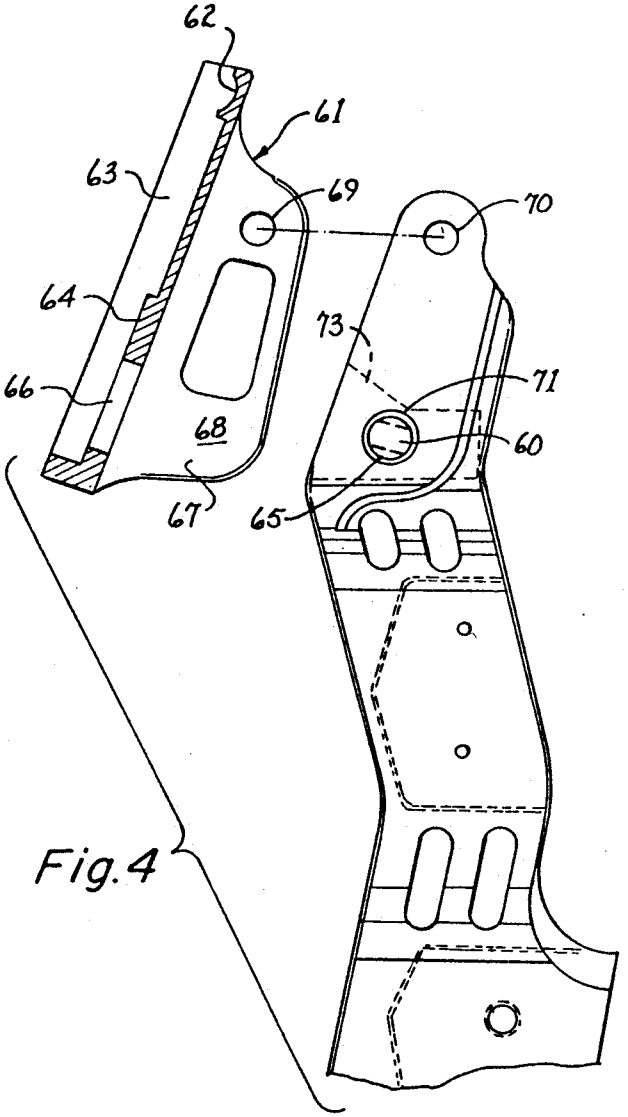
FIG. 4 is an exploded view, partially in section, of the handle and pivoting pocket of the archery bow of FIG. 1.

FIGS. 4–6 illustrate various anchoring means for receiving adjustment bolt 22 of FIGS. 1 and 2. Pocket member 61 includes recess 63 having end portion 62. The upper surface of end portion 62 is concave, having a semi-circular cross-section for receiving a half-round member to couple the end of pocket member 61 to the limb. A bow limb to be supported rests on shelf 64 and the limbs half-round member in portion 62. Shelf 64 and portion 62 are coplanar. Shelf 64 includes bore 66 to provide clearance for adjustment bolt 22 of FIGS. 1 and 2.

For assembly, bores 69 and 70 are aligned and a pin inserted through both bores. In a preferred embodiment, bore 71 is covered by wall 67 of pocket member 61 (and the corresponding opposing wall, not shown in FIG. 4). Anchor pin 65, located in bore 71, has threaded bore 60 perpendicular to the long axis of the pin for receiving the adjustment bolt. Anchor pin 65 can rotate within bore 71 to thereby rotate in conjunction with the movement of the end of the limb as the weight adjustment is made. Cavity 73 provides clearance for the adjustment bolt to move up or down as the limb is loosened or tightened.

FIG. 5 illustrates an alternative anchoring means comprising a threaded nut located in bore 75 having an arcuate cross-section. Specifically, surface 76 is convex. Nut 78 has planar major surfaces, the upper one of which engages surface 76 of bore 75. As the pocket member and limb pivot, nut 78 is free to pivot slightly within bore 75 to remain aligned with the adjustment nut and not bind.

FIG. 6 illustrates another alternative anchoring means in which bore 81 has straight sides and nut 82 has a convex or spherical crown to engage the flat inner surface of bore 81. Because the upper surface of nut 82 is curved, the nut can pivot slightly with the motion of the adjustment pin as the draw weight is adjusted.

The invention thus provides an improved means for attaching limbs to the handle of an archery bow. The joints are fully enclosed so that the limbs cannot fall off the bow when relaxed or when the bowstring has been removed. The limb is held firmly in the recess of the pocket member at all times and for all adjustments of the draw weight. The pocket member itself cannot be moved from side to side since it straddles the handle.

Having thus described the invention, it will be apparent to those of skill in the art that various modifications can be made within the scope of the invention. For example, although it is preferred that the pocket member immure the anchor pin, a slot can be provided in the walls of the pocket member to clear the anchor pin and its fastening means. This would tend to require that the pocket be slightly longer or that the distance between the pivot pin and the anchor pin be reduced, which would increase the torque on the end of the handle. While shown and described in conjunction with a compound bow, the invention will find applicability to archery bows utilizing limbs secured to an intermediate inflexible handle.

I claim:

1. An archery bow comprising:

a handle having an end and a first bore and a second bore in said end;

a limb having a fixed end for attachment to said handle and an opening in said fixed end;

a pocket member connected to the end of said handle and to said fixed end, said pocket member having a first bore and a second bore, wherein said first bore in said pocket member is orthogonal to said second bore in said pocket member;

a pivot pin passing through said first bore in said handle and said first bore in said pocket member for pivotally attaching said pocket member to said handle;

a bolt passing through said opening and through said second bore in said pocket member, said bolt extending into said second bore in said handle; and threaded anchor means located in said second bore in said handle, said threaded anchor means engaging said bolt to fasten said limb to said handle;

said threaded anchor means being movable within said second bore in said handle to permit said bolt to pivot with said pocket member and said limb while fastening said limb to said handle.

2. The archery bow as set forth in claim 1 wherein said pocket member includes a recess for receiving said fixed end of said limb and includes wall portions extending away from said recess and straddling said handle.

3. The archery bow as set forth in claim 2 wherein said wall portions trap said anchor means within said handle.

4. The archery bow as set forth in claim 1 wherein said anchor means is a pin rotatable in said second in bore in said handle.

5. The archery bow as set forth in claim 1 wherein said anchor means comprises a pin having a threaded bore perpendicular to the long axis thereof.

6. The archery bow as set forth in claim 1 wherein said anchor means comprises a nut in said second bore in said handle, wherein said second bore in said handle is parallel to said pivot pin and has an arcuate cross-section.

7. The archery bow as set forth in claim 1 wherein said anchor means comprises a nut having a convex major surface.

8. In an archery bow having a handle and a pair of limbs mounted to said handle, the improvement comprising:

(a) a pair of parallel bores in each end of said handle;

(b) a pair of pocket members for connecting said limbs to said handle, each of said pocket members having a bore;

(c) a pair of pins for each pocket member, a first pin of each pair passing through the bore in a respective pocket member and one of the bores at each end of said handle and the second pin of each pair being located within the other bore at each end of said handle, wherein said pocket member can pivot about a respective first pin; and (d) means for maintaining each of said second pins within the respective other bores in said limb.

9. The bow as set forth in claim 8 wherein said pocket members each include a recess having a surface for receiving one end of a limb.

10. The bow as set forth in claim 9 wherein each of said pocket members further comprises a pair of walls extending perpendicular to said surface and away from said recess, said walls straddling said handle and include said bore for said first pin.

11. The bow as set forth in claim 9 wherein the recess in each pocket has an open end through which said limb extends.

12. The bow as set forth in claim 8 wherein said parallel bores are perpendicular to the long dimension of said handle.

13. The bow as set forth in claim 8 wherein said means for maintaining each of said second pins within the respective other bores comprises, for each end of said handle, a bolt passing through the end of said limb, through said pocket member and engaging said second pin.

14. The bow as set forth in claim 8 wherein said pair of parallel bores are spaced along the long dimension of the handle and wherein said first pin of each pair passes through the bore nearest its respective end of the handle.

15. A compound bow for archery having a handle, a pair of limbs each having a fixed end for attachment to said handle and a free end;

a pair of eccentrics attached respectively to the free ends of each of said limbs;

a bow string interconnecting the free ends of said limbs through said eccentrics;

a pair of pocket members connected one each to the ends of said handle and the fixed ends of the limbs, each pocket member having a pair of bores orthogonal to each other through the pocket member;

pivot pin means for attaching said pocket members to said handle through a first of said pair of bores; and adjustment means for anchoring each of said limbs to said handle through the second of said pair of bores, said adjustment means including, at each end of said handle, an anchor means located in a bore in said handle and a threaded bolt for engaging said anchor means.

16. The combination set forth in claim 15 wherein each pocket member includes a recess for receiving one of said limbs and a pair of walls extending from opposite sides of said pocket member for straddling an end of said handle.

17. The combination set forth in claim 15 wherein said walls trap said anchor means within said handle.

18. The combination set forth in claim 15 wherein said anchor means comprises a pin having a threaded bore perpendicular to the long axis thereof.

19. The combination set forth in claim 15 wherein said anchor means comprises a nut in a bore in said handle, and wherein said bore in said handle is parallel to said pivot pin means and has an arcuate cross-section.

20. The combination set forth in claim 15 wherein said anchor means comprises a nut having a convex major surface.

* * * * *